US005657882A

United States Patent [19]

Johnson

[11] Patent Number: 5,657,882

[45] Date of Patent: Aug. 19, 1997

[54] PORTABLE CUE HOLDER

[76] Inventor: Jaye J. Johnson, 851 Loma Dr., Ojai, Calif. 93023

[21] Appl. No.: 550,447

[22] Filed: Oct. 30, 1995

[51] Int. Cl.[6] ..... A47F 7/00

[52] U.S. Cl. ..... 211/68; 211/86.01; 211/89.01; 248/229.12; 411/104; 24/525

[58] Field of Search ..... 211/68, 86, 89; 248/229.12, 229.22, 227.2, 228.3, 231.41, 689; 24/525, 569; 403/6; 411/104, 389; 81/165, 166, 167

[56] References Cited

U.S. PATENT DOCUMENTS

| | | | |
|---|---|---|---|
| 413,119 | 10/1889 | Weyant | 248/227.2 X |
| 788,716 | 5/1905 | Hammond et al. | 24/569 X |
| 1,009,090 | 11/1911 | Parker | 81/165 |
| 1,117,024 | 11/1914 | Gathright | 411/389 X |
| 1,309,874 | 7/1919 | Arnot | 81/165 |
| 1,423,793 | 7/1922 | Green | 81/165 |
| 1,988,240 | 1/1935 | Ellis | 24/569 X |
| 2,142,019 | 12/1938 | Warner | 248/94 X |
| 3,447,727 | 6/1969 | Lowe | 248/231.41 X |
| 4,466,596 | 8/1984 | Cohen | 248/231.41 X |
| 4,903,929 | 2/1990 | Hoffman | 248/229 |
| 4,979,273 | 12/1990 | Friedrickson et al. | 24/525 |
| 5,072,908 | 12/1991 | Lodrick | 248/231.8 |
| 5,255,799 | 10/1993 | Haynes | 211/68 |
| 5,320,444 | 6/1994 | Bookwalter et al. | 403/323 |
| 5,370,570 | 12/1994 | Harris | 446/227 |

*Primary Examiner*—Robert W. Gibson, Jr.
*Attorney, Agent, or Firm*—Marvin E. Jacobs

[57] ABSTRACT

A cue holder including an upper member and a lower member having a plurality of rubber lined holders for cues and having a set of aligned jaws for removable attachment to a table. The jaws are adjusted by a threaded knob received in a horizontal opening in the lower jaw and on to a threaded bolt. As the knob is rotated, the lower jaw moves up and down relative to the upper jaw. A peg may be secured in the upper jaw and slidingly received in the lower jaw to prevent rotation of the jaws relative to each other.

11 Claims, 2 Drawing Sheets

PORTABLE CUE HOLDER

CROSS-REFERENCE TO DISCLOSURE DOCUMENT

The present invention is disclosed in Disclosure Document No. 370305 received Feb. 21, 1995.

TECHNICAL FIELD

The present invention relates to a portable holder for elongated objects such as pool cues and, more particularly this invention relates to a cue holder that can be releasably clamped to a table top and that holds the cue in a vertical position.

BACKGROUND OF THE INVENTION

Billiards and pocket billiards (pool) have recently experienced a resurgence in popularity. At least one billiard parlor or club can be found in every city and town in the United States. Many bars have at least one billiard table for the use of their customers. Serious billiard players usually purchase one or more pool cues which can cost from fifty dollars to several thousand dollars each. The cues are formed of expensive woods or composites and can be scratched or damaged if handled roughly or carelessly. Billiard parlors usually position billiard tables within a dedicated area. Racks for pool cues are usually found on the exterior wall far from some of the billiard tables.

The play of pool and billiards is by rotation of 2 or 4 players. When a player is not playing, he is usually seated in a chair adjacent a refreshment table. The player would like to retain possession of his cue when resting since the trip to the rack takes time and delays the game when the preceding player is finished and he is called to play. Furthermore, the rack can be out of his view and another player can accidentally or purposefully remove his cue from the common rack.

| U.S. Pat. No. | Patentee |
|---|---|
| 4,903,929 | Hoffman |
| 5,072,908 | Lodrick |
| 5,255,799 | Haynes |
| 5,320,444 | Bookwalter, et al. |
| 5,370,570 | Harris |

STATEMENT OF THE PRIOR ART

Hoffman discloses a portable cue holder in which resilient clips are mounted on a C-clamp which attaches to a leg of a table.

Lodrick discloses a portable pool cue holder in which a cue engagement members are mounted on a pivoted, spring biased clamp formed of 2 planar strips.

Haynes attaches his portable cue holder to the edge of a table by means of a bolt mounted in a C-clamp.

Bookwalter discloses a surgical apparatus clamp in which a threaded rod and nut are enclosed.

Harris discloses a 2 piece clamp for a toy mobile tightened by a threaded bolt.

These prior clamps are formed of metal C-clamps or complicated, multipart holders. The clamps are adjusted by bolts which extend from the device when positioned at the edge of a table. The extension of the bolt can catch onto and rip clothing of players or spectators as they pass by the table on which the cue holder is mounted. The extension of the bolt requires larger carrier pouches and can penetrate and damage the pouch.

STATEMENT OF THE INVENTION

A portable cue holder is provided according to the invention that does not have a bolt extending from the surface of the holder. The holder is readily adjustable to fit the thickness of the edge of table tops normally used in lounge areas of billiard parlors. The cue holder of the invention has at least one cushioned recess that grasps and holds the cue in vertical position without harming or scratching the cue.

The cue holder of the invention includes only two jaw members that move parallel to each other to loosen or close the clamp onto the edge of a table. The jaws are moved by rotating a threaded knob mounted in a horizontal opening through the lower member and received on a threaded shaft received through aligned bores in both clamp members. Rotation of the knob moves the lower jaw member upwards or downwards to close or open the clamp.

The cue holder of the invention is readily manufactured from numerous materials to an elegant attractive product. The holder can be formed of wood, metal, plastic or composites. It is readily carried in a Docket or a carrying pouch. It can be installed or removed from a table in seconds. Cues are safely stored within the view of the owner or user and can be removed and installed in the holder without fear of scratching or chipping or breaking the cue.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
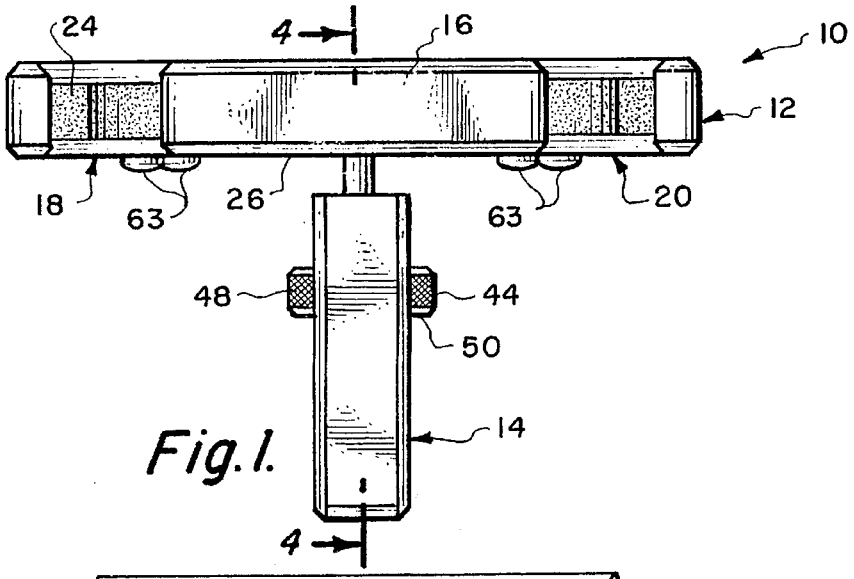
FIG. 1 is a front view in elevation of the portable cue holder of the invention.
Figure 2:
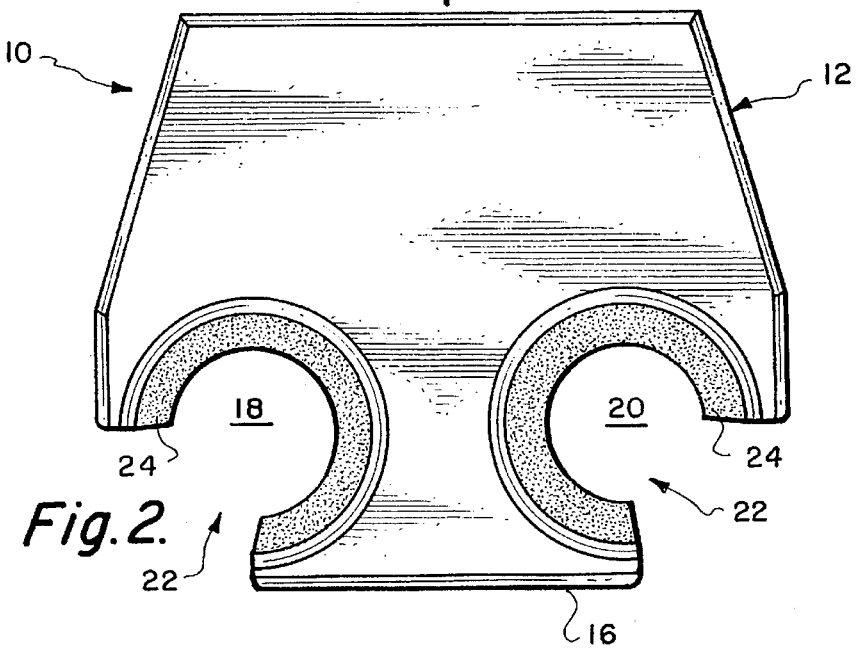
FIG. 2 is a view in perspective of the portable cue holder.
Figure 3:
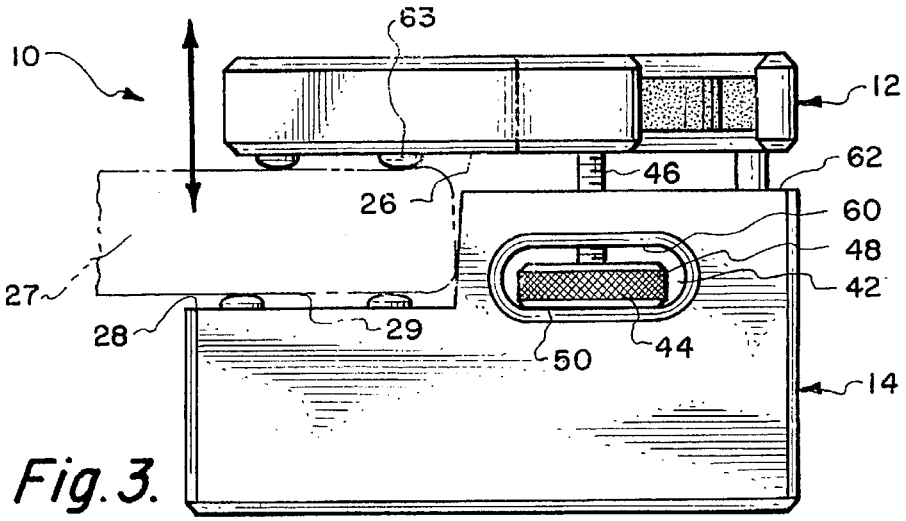
FIG. 3 is a side view in elevation of the portable cue holder.
Figure 4:
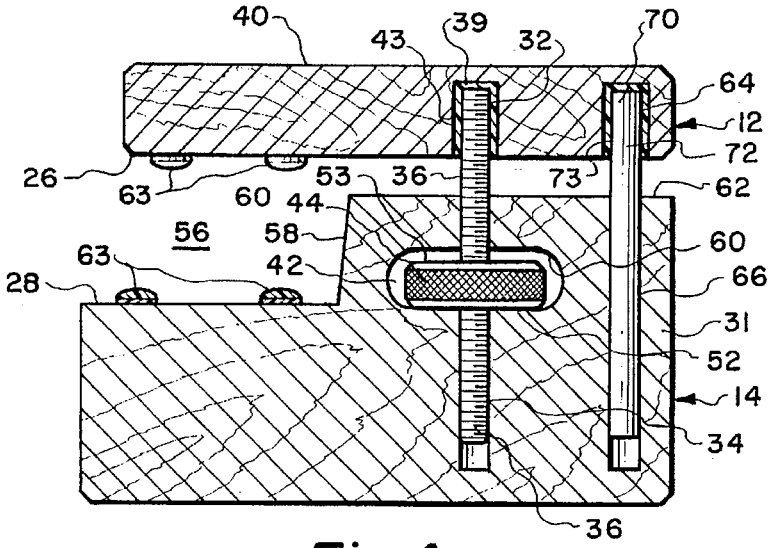
FIG. 4 is a view in section taken along lines 4—4 of FIG. 1.

Referring now to FIGS. 1–4, the cue holder 10 of the invention generally includes an upper member 12 and a lower member 14. At least one of the members, preferably the upper member 12 has a front surface 16 containing at least one, preferably 2–4, cylindrical recesses 18, 20 for frictionally holding billiard cues, not shown. The recesses 18, 20 each have an opening 22 in the front surface 16 for receiving the cues. The recesses 18, 20 contain a liner 24 of an elastomer such as natural or synthetic rubber for frictionally holding a cue.

Figure 5:
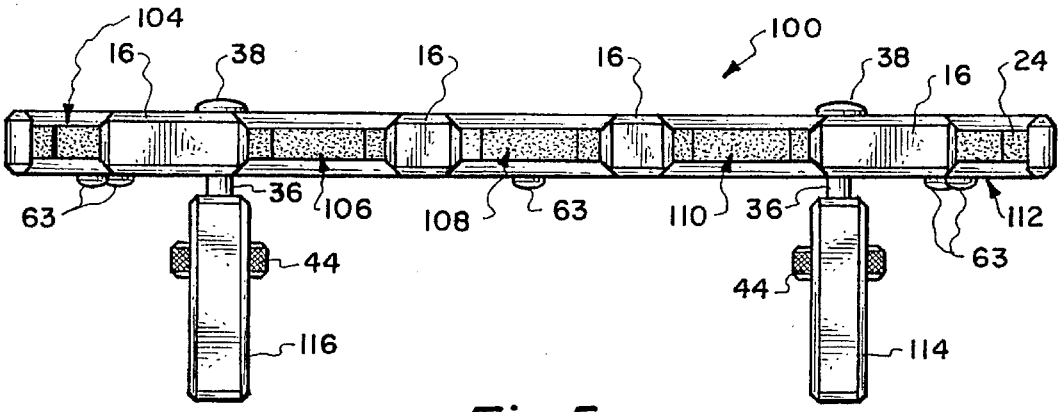
FIG. 5 is a front view in elevation of another embodiment of a portable cue holder.
Figure 6:
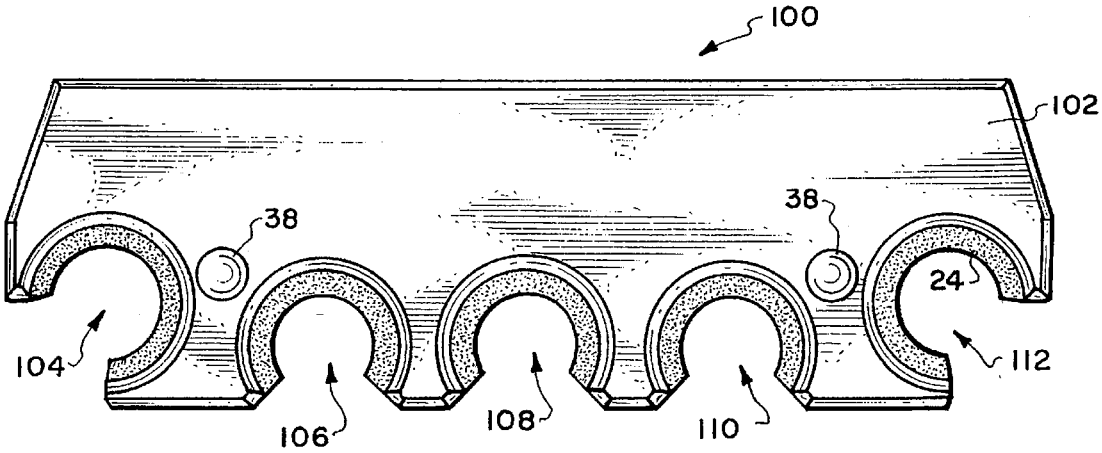
FIG. 6 is a top view in elevation of the cue holder shown in FIG. 5.

The upper member 12 has a bottom planar surface 26 for engaging the top surface of a table 27 shown in dotted lines. The lower member 14 is L-shaped. A planar, upper surface 28 is located on a leg 30 of the lower member 14 for engaging the bottom surface 29 of the table 27. The members 12 and 14 each contain vertical bores, 32, 34 which, when aligned, receive a bolt 36. The top end 39 of the bolt 36 can be recessed from the top surface of the upper member 12. The bolt 36 can be secured in cavity 12 by adhesive or a bushing 43. As shown in FIGS. 5–6, the heads 38 of the bolts 36 can be received on the top surface 40 of the upper member 12. The bolt heads 38 can be rounded, flat or can be recessed. A rectangular, horizontal opening 42 is provided through the lower member 14 intersecting the vertical aperture 34. A knob 44 having an internally threaded bore, sized to engage the threads of the shank 46 of the bolt 36, is received on the bolt 36. The outside edge of the knob 44 can contain a high friction surface 48 such as a knurled edge.

When the knob 44 is rotated in a first direction, the bottom surface 50 of the knob 44 presses against the bottom wall 52 of the opening 42. The lower member 14 moves downwardly to create a space 56 between planar surfaces 26, 28 which permits insertion of the edge of the table 27 into the space 56 and into abutment with the horizontal wall 58 on the inner surface of the leg 31. When the knob 44 is rotated in the opposite direction, the knob 44 moves upwardly and its upper surface 53 presses against the top wall 60 of the opening 42 and raises the lower member 14 toward the top member 12 until the surfaces 26, 28 engage and clamp onto the table top or the bottom surfaces 26 of the upper member 12 comes into engagement with the top surface 62 of the leg 31. The mating surfaces 26, 28 may contain adhesively secured gripping tabs 63.

In order to prevent rotation of upper member 12 in relation to lower member 14, a second set of vertically aligned apertures 64, 66 can be formed in the members 12, 14. The width of the aperture 64 in the top member is preferably smaller than the width of the aperture 66 and preferably does not extend through the top member to the upper surface 40 thereof. The upper end 70 of a cylindrical peg 72 is received in the aperture 64 by friction and/or an adhesive film 73. These apertures 64, 66 are preferably parallel to the bolt 36. The bolt shank 46 and peg 72 housed in parallel sleeves prevent rotation of the top 12 and bottom 14 members relative to each other. However, the lower member 14 freely moves up and down on peg 72 which is slidingly received in the aperture 66.

Referring now to FIGS. 5 and 6, a further embodiment of a cue holder 100 is shown. This cue holder 100 is intended for use by teams. The main difference is that the top member 102 contains five cue holding cavities, 104, 106, 108, 110, 112. There are 2 bottom members 114, 116 instead of one in order to better support the load and to stabilize the cue holder 100 from tipping or breaking. Each bottom member 114, 116 contains an anti-rotation peg, not shown. All other structure is the same as the embodiments illustrated in FIGS. 1–4.

It is to be realized that only preferred embodiments of the invention have been described and that numerous substitutions, modifications and alterations are permissible without departing from the spirit and scope of the invention as defined in the following claims.

I claim:

1. A portable cue holder for releasable mounting on a horizontal member having parallel surfaces comprising in combination:

an upper member having a planar bottom surface and having a top surface and a front surface, said front surface having at least one cue engaging cavity in the upper member;

a lower member having a lower surface and a rear portion with a first planar upper surface portion and a front portion with a second planar upper surface lower then the first surface, both the first and second surfaces being parallel at all times to the bottom surface of the upper member and the second upper face and the lower surface of the upper member forming jaws for engaging the horizontal member a first vertical bore formed through said upper member and a second vertical bore formed through said lower member;

a horizontal aperture formed through said lower member intersecting said second bore;

an internally threaded nut received in the horizontal aperture; and a bolt having a threaded shank received through said nut and vertical bores when they are aligned whereby on rotation of said nut on said threaded shank, the bottom member moves horizontally relative to the top member and clamps onto or releases the horizontal member.

2. A cue holder according to claim 1 in which the bolt has a head larger than said shank and bores.

3. A cue holder according to claim 2 in which the head of the bolt is received on the top surface of the upper member.

4. A cue holder according to claim 1 in which the cavities have a front opening.

5. A cue holder according to claim 4 in which the inner edge of each cavity is covered with a strip of elastomer.

6. A cue holder according to claim 1 in which the nut has a width larger then the width of the bottom member and extends therefrom.

7. A cue holder according to claim 6 in which the outer surface of the nut has a high friction surface.

8. A cue holder according to claim 7 in which the high friction surface is a knurled surface.

9. A cue holder according to claim 1 further including a second bore in said upper member and a second bore in said lower member aligned therewith, a peg received in said aligned second bore and means for securing the peg in said aligned bores.

10. A cue holder according to claim 1 in which an end of said peg is frictionally and/or adhesively received in said second bore of the upper member.

11. A cue holder according to claim 10 in which the second bore only extends partially through the upper member.

* * * * *